US012758018B2

(12) United States Patent
Zhou et al.

(10) Patent No.: US 12,758,018 B2
(45) Date of Patent: Oct. 13, 2026

(54) SOFA CHAIR

(71) Applicant: DEWERTOKIN TECHNOLOGY GROUP CO., LTD., Jiaxing (CN)

(72) Inventors: Weiyao Zhou, Jiaxing (CN); Long Li, Jiaxing (CN); Liming Yang, Jiaxing (CN)

(73) Assignee: DEWERTOKIN TECHNOLOGY GROUP CO., LTD., Jiaxing (CN)

( * ) Notice: Subject to any disclaimer, the term of this patent is extended or adjusted under 35 U.S.C. 154(b) by 186 days.

(21) Appl. No.: 18/715,934

(22) PCT Filed: Dec. 1, 2022

(86) PCT No.: PCT/CN2022/136009
§ 371 (c)(1),
(2) Date: Jun. 3, 2024

(87) PCT Pub. No.: WO2023/103886
PCT Pub. Date: Jun. 15, 2023

(65) Prior Publication Data

US 2025/0057317 A1 Feb. 20, 2025

(30) Foreign Application Priority Data

Dec. 8, 2021 (CN) ..... 202123061362.6

(51) Int. Cl.
*A47C 1/0355* (2013.01)
*A47C 7/40* (2006.01)
(Continued)

(52) U.S. Cl.
CPC ..... *A47C 7/40* (2013.01); *A47C 17/86* (2013.01); *A47C 31/126* (2013.01)

(58) Field of Classification Search
CPC ..... A47C 7/40; A47C 17/86; A47C 31/126; A47C 1/0355; A47C 1/0345; A47C 1/0242
See application file for complete search history.

(56) References Cited

U.S. PATENT DOCUMENTS 11,219,314 B2 * 1/2022 Zhang ..... A47C 1/0355
11,564,498 B1 * 1/2023 Li ..... A47C 17/04
(Continued)

FOREIGN PATENT DOCUMENTS

CN 203314480 U 12/2013
CN 203314481 U 12/2013
(Continued)

OTHER PUBLICATIONS

International Search Report for corresponding application PCT/CN2022/136009 filed Jan. 12, 2022; Mail date Feb. 23, 2023.

*Primary Examiner* — David R Dunn
*Assistant Examiner* — Jessica Kathryn Thompson
(74) *Attorney, Agent, or Firm* — CANTOR COLBURN LLP

(57) ABSTRACT

A sofa chair includes a base, a chair frame assembly, a backrest assembly and a leg telescoping assembly. The chair frame assembly includes a chair frame bracket and a chair frame disposed on the chair frame bracket. The chair frame assembly is movably connected to the base by a connection rod structure. The sofa chair is configured to, in response to changing the state of the connection rod structure, switch between the sitting posture, the TV posture, and the fully lying posture. When the sofa chair is in the fully lying posture, the first included angle between the chair frame and the horizontal plane is greater than 26 degrees and less than 30 degrees, and the first height between the lowest point of the chair frame and the ground is 60 mm to 100 mm.

15 Claims, 4 Drawing Sheets

(51) Int. Cl.
*A47C 17/86* (2006.01)
*A47C 31/12* (2006.01)

(56) References Cited

U.S. PATENT DOCUMENTS

| | | | | |
|---|---|---|---|---|
| 12,207,731 | B2 * | 1/2025 | Yang | A47C 17/163 |
| 12,408,755 | B2 * | 9/2025 | Lake | A47C 1/0355 |
| 12,478,192 | B2 * | 11/2025 | Liu | A47C 1/0342 |
| 12,520,941 | B1 * | 1/2026 | Zhou | A47C 1/0355 |
| 2014/0132038 | A1 * | 5/2014 | Lu | A47C 1/035 297/68 |
| 2021/0361070 | A1 | 11/2021 | Zhang et al. | |
| 2024/0215726 | A1 * | 7/2024 | Li | A47C 1/0345 |

FOREIGN PATENT DOCUMENTS

| | | | |
|---|---|---|---|
| CN | 208957312 | U | 6/2019 |
| CN | 216256324 | U | 4/2022 |

* cited by examiner

SOFA CHAIR

CROSS-REFERENCE TO RELATED APPLICATION(S)

This is a national stage application filed under 37 U.S.C. 371 based on International Patent Application No. PCT/CN2022/136009, filed Dec. 1, 2022, which claims priority to Chinese Patent Application No. 202123061362.6 filed with the China National Intellectual Property Administration (CNIPA) on Dec. 8, 2021, the disclosure of which is incorporated herein by reference in its entirety.

TECHNICAL FIELD

The present application relates to the field of furniture technologies, for example, a sofa chair.

BACKGROUND

Chairs are common seating devices in life. A chair typically includes a backrest and an armrest. A chair of the related art is mostly a simple structure having simple functions, so the chair cannot be adjusted and thus is less comfortable.

To improve the comfort of a user when the user lies or sits, some chairs can be adjusted to a zero-gravity state, such as a massage chair with a slideway-type zero-gravity structure disclosed by the Chinese Patent No. CN213157432U. This chair has a zero-gravity effect and thus can improve the user comfort and the massage and relaxation effect. This chair is driven by an electric push rod to switch between a zero-gravity posture and a standing posture.

When the zero-gravity chair is in the fully lying posture, the included angle between the seat plane of the zero-gravity chair and the horizontal plane is relatively small, and thus the zero-gravity experience effect is not noticeable. In addition, to implement the zero-gravity experience, the zero-gravity chair involves raising a leg unit. This is generally implemented by sinking the backrest. When the backrest sinks to a certain degree, the backrest interferes with the electric motor, affecting installation of the electric motor.

SUMMARY

The present application provides a sofa chair so that the included angle between the seat plane and the horizontal plane is larger, the zero-gravity experience is more noticeable, and the seat does not interfere with the electric motor.

Provided is a sofa chair. The sofa chair includes a base disposed horizontally, a chair frame assembly indirectly and movably connected to the base, a backrest assembly movably connected to one end of the chair frame assembly, and a leg telescoping assembly movably connected to another end of the chair frame assembly. The chair frame assembly includes a chair frame bracket and a chair frame disposed on the chair frame bracket. The chair frame assembly is movably connected to the base by a connection rod structure. The sofa chair is switchable between the sitting posture, the TV posture and the fully lying posture by changing the state of the connection rod structure. When the sofa chair is in the fully lying posture, the first included angle between the chair frame and the horizontal plane is greater than 26 degrees and less than 30 degrees, and the first height between the lowest point of the chair frame and the ground is 60 mm to 100 mm.

REFERENCE LIST

1. base. 2. backrest assembly, 3. chair frame assembly, 4. leg telescoping assembly, 11. first support rod. 12. second support rod. 21. backrest support, 22. backrest connector, 23. extension part, 51. first connection rod, 52. second connection rod, 53. third connection rod, 54. fourth connection rod, 55. fifth connection rod, 30. chair frame, 31. chair frame bracket, 311. first portion, 312. second portion

DETAILED DESCRIPTION

Embodiments of the present application are described hereinafter based on drawings. The description of embodiments of the present application is not intended to limit the scope of the present application.

Figure 1:
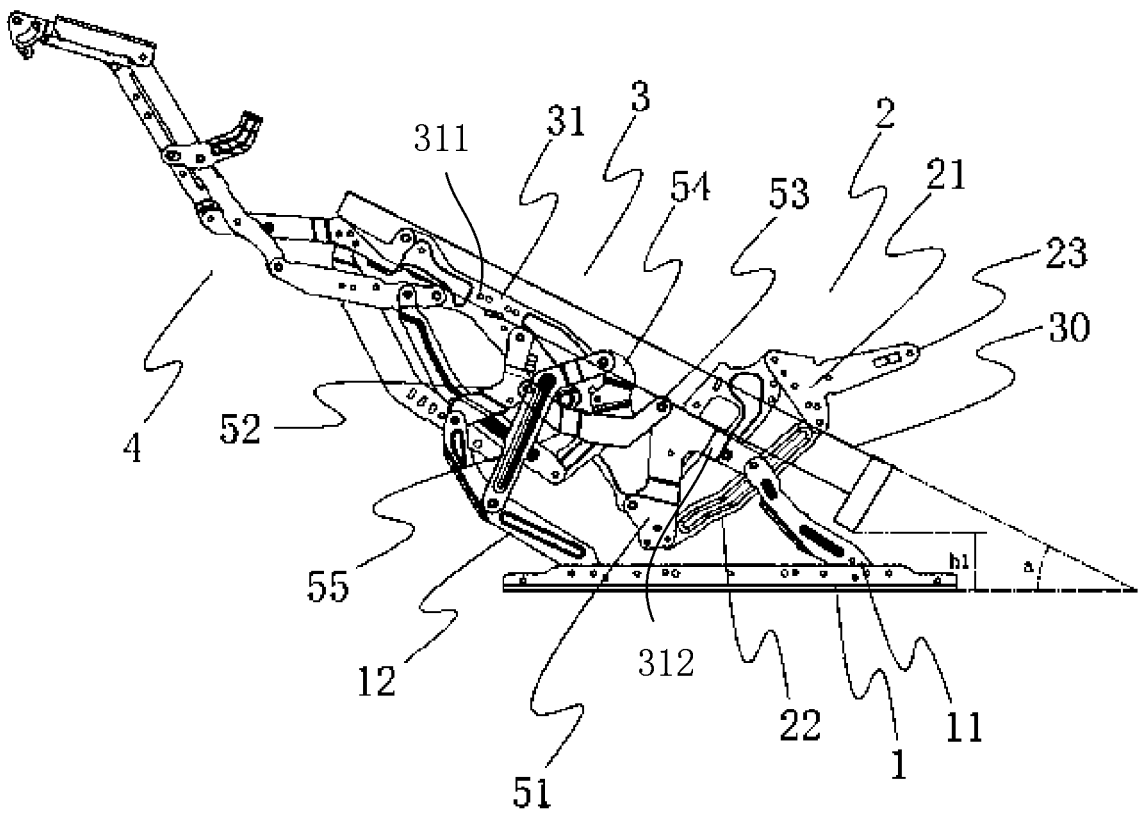
FIG. 1 is a side view of a sofa chair in the fully lying posture according to the present application.
Figure 2:
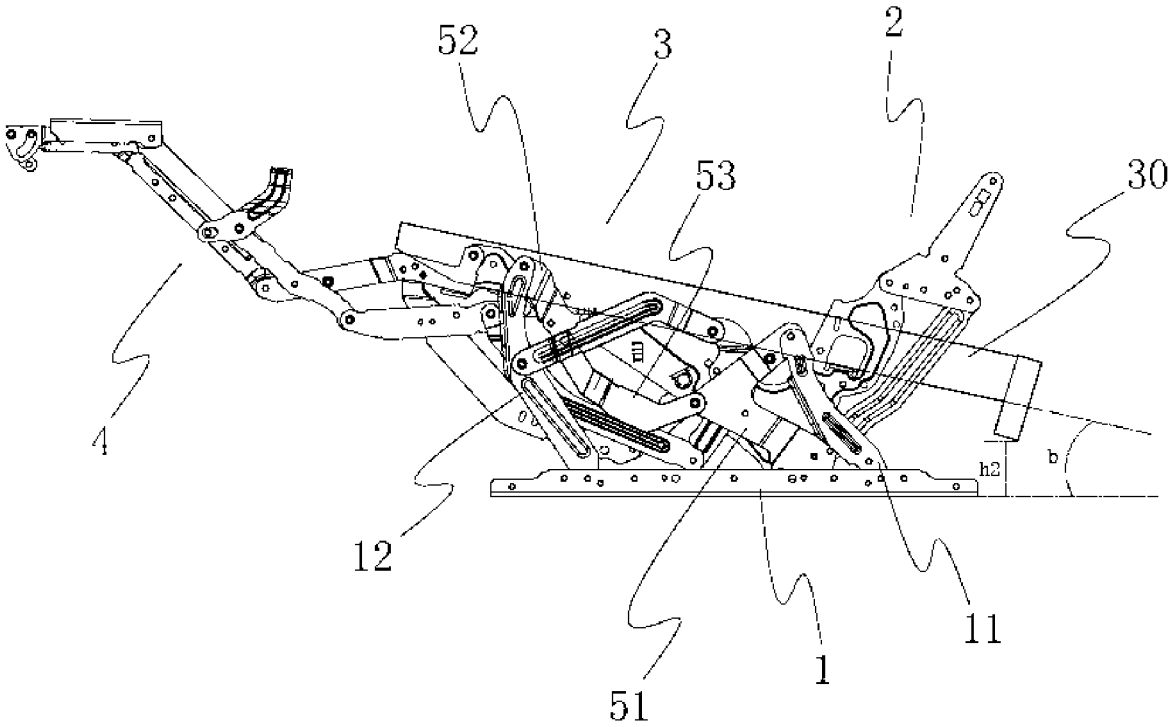
FIG. 2 is a side view of a sofa chair in the TV posture according to the present application.
Figure 3:
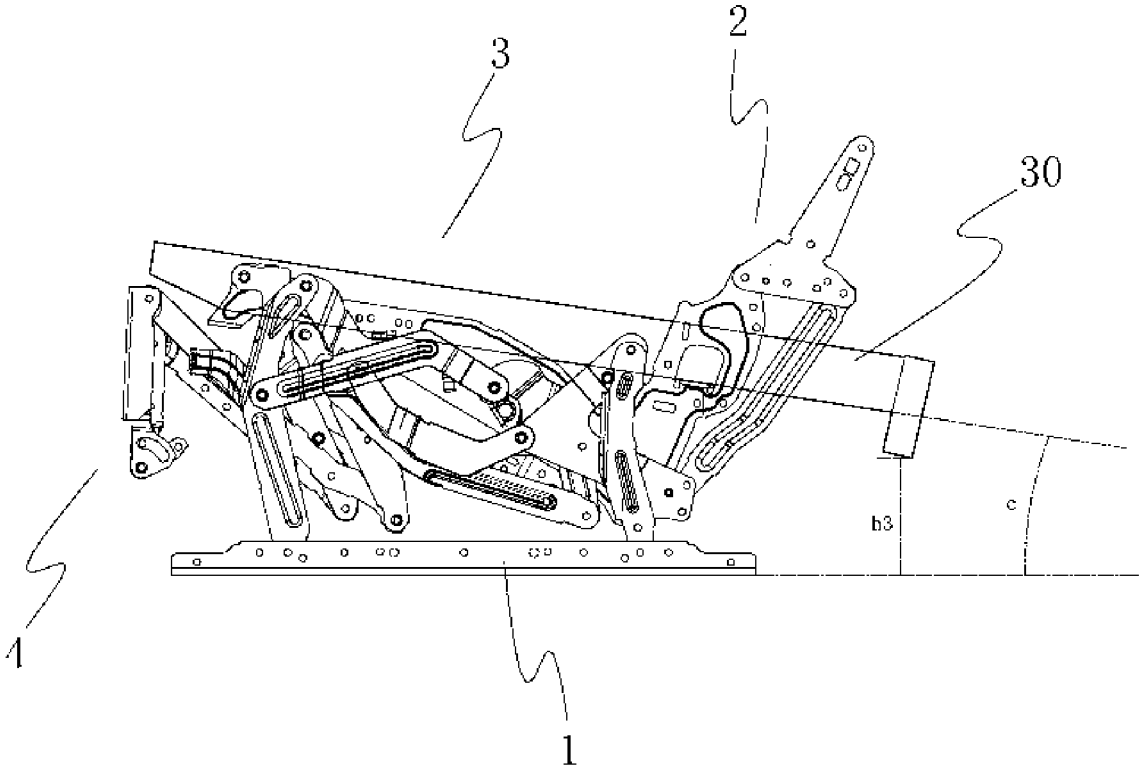
FIG. 3 is a side view of a sofa chair in the sitting posture according to the present application.
Figure 4:
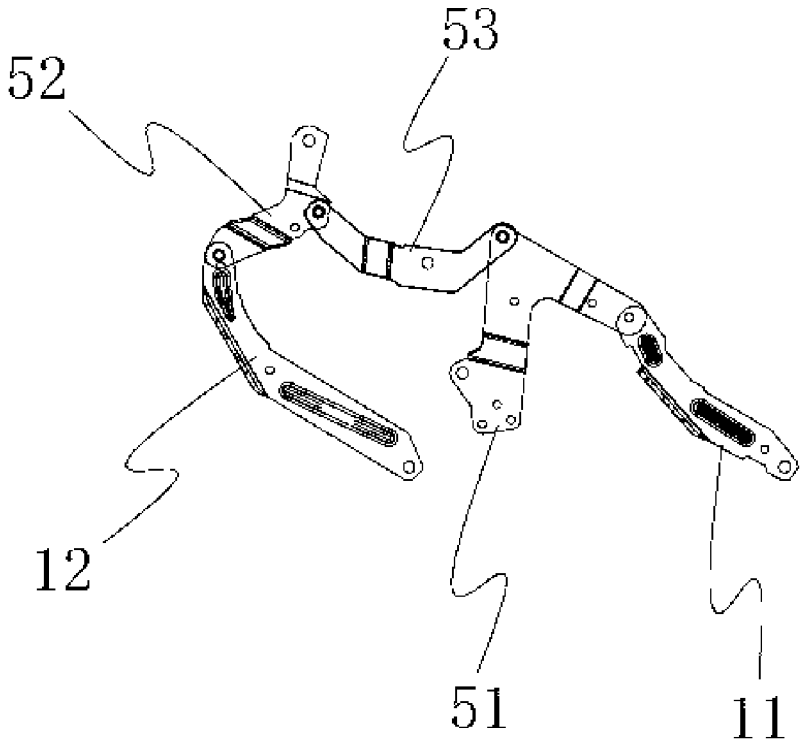
FIG. 4 is a diagram of a first connection rod, a second connection rod, and a third connection rod of FIG. 1.

Referring to FIG. 1 to FIG. 4, the multi-state switchable sofa chair of the present application includes a base 1 disposed horizontally, a chair frame assembly 3 indirectly and movably connected to the base 1, a backrest assembly 2 movably connected to one end of the chair frame assembly 3, and a leg telescoping assembly 4 movably connected to another end of the chair frame assembly 3. The chair frame assembly 3 includes a chair frame bracket 31 and a chair frame 30 disposed on the chair frame bracket 31.

The chair frame assembly 3 is movably connected to the base 1 by a connection rod. The sofa chair is configured to switch between the sitting posture, the television (TV) posture, and the fully lying posture as the state of the connection rod structure changes. When the sofa chair is in the fully lying posture. the first included angle between the chair frame 30 and the horizontal plane is greater than 26 degrees and less than 30 degrees, and the first height between the lowest point of the chair frame 30 and the ground is 60 mm to 100 mm. Alternatively, the first height is 65 mm to 75 mm.

The first included angle may be 27 degrees. The first height may be 68±1 mm.

The connection rod structure includes a first support rod 11, a second support rod 12, a first connection rod 51, a second connection rod 52, and a third connection rod 53.

The first support rod 11 is hinged at a position of the base 1 adjacent to one end of the base 1, and the second support rod 12 is hinged at a position of the base 1 adjacent to another end of the base 1.

The chair frame assembly 3 includes a chair frame bracket 31 and a chair frame 30. The chair frame bracket 31 is generally L-shaped. The chair frame bracket 31 includes a first portion 311 that is relatively long and a second portion 312 that is relatively short and angularly connected to the first portion 311. The chair frame 30 is disposed on the first portion 311 of the chair frame bracket 31.

The backrest assembly 2 includes a backrest support 21 and a backrest connector 22. The first end of the backrest support 21 is hinged to the end of the second portion 312 of the chair frame bracket 31, and the second end of the backrest support 21 is hinged to the first end of the backrest connector 22.

An extension part 23 obliquely protrudes from the backrest support 21.

The leg telescoping assembly 4 is movably connected to the first portion 311 of the chair frame bracket 31. The leg telescoping assembly 4 includes at least one connection rod. The structure of the leg telescoping assembly 4 is known in the art and thus is not described here again.

The first connection rod 51 is hinged at the position where the first portion 311 of the chair frame bracket 31 is connected to the second portion 312 of the chair frame bracket 31. An end of the first connection rod 51 is hinged to the first support rod 11. The second connection rod 52 is hinged to the middle of the first portion 311 of the chair frame bracket 31. An end of the second connection rod 52 is hinged to the second support rod 12.

The distance from the hinge point between the first connection rod 11 and the first support rod 51 to the hinge point between the base 1 and the first support rod 11 is 175 mm to 200 mm. The distance from the hinge point between the first connection rod 11 and the first support rod 51 to the hinge point between the base 1 and the first support rod 11 may be 183±1 mm.

The third connection rod 53 connects the middle of the first connection rod 51 and the middle of the second connection rod 52.

The first connection rod 51 is V-shaped.

The distance from the hinge point between the first connection rod 51 and the first support rod 11 to the hinge point between the first connection rod 51 and the third connection rod 53 is 120 mm to 130 mm. The distance from the hinge point between the first connection rod 51 and the first support rod 11 to the hinge point between the first connection rod 51 and the third connection rod 53 may be 127±1 mm.

The first portion 311 of the chair frame bracket 31 is hinged to a fourth connection rod 54 at a position between the first connection rod 51 and the second connection rod 52. An end of the fourth connection rod 54 is hinged to a fifth connection rod 55. An end of the fifth connection rod 55 is hinged to the middle of the second support rod 12.

The second end of the backrest connector 22 is hinged to an end of the first connection rod 51 facing away from the first support rod 11.

When the sofa chair is in the TV posture, the second included angle between the chair frame and the horizontal plane is 10 degrees to 15 degrees, and the second height between the lowest point of the chair frame and the ground is 55 mm to 75 mm. The second included angle may be 12±1 degrees. The second height may be 61±1 mm.

When the sofa chair is in the sitting posture, the third included angle between the chair frame 30 and the horizontal plane is 5 degrees to 11 degrees, and the third height between the lowest point of the chair frame 30 and the ground is 90 mm to 140 mm. The third included angle may be 9±1 degrees. The third height may be 105±1 mm.

Referring to FIG. 1 again, when the sofa chair is in the fully lying posture, the first included angle a between the chair frame 30 and the base 1 (that is, the horizontal plane) is greater than 26 degrees, where the first included angle a between the chair frame 30 and the base 1 (that is, the horizontal plane) may be greater than 26 degrees and less than 30 degrees, for example, may be 27 degrees. Compared with the zero-gravity chair of the related art, when the sofa chair of the present application is in the fully lying posture, the included angle between the chair frame 30 and the ground is larger, and thus the zero-gravity effect is more noticeable. When the sofa chair is in the fully lying posture, the first height hl between the lowest point of the chair frame 30 and the ground is 60 mm to 100 mm, for example, may be 68±1 mm. When the sofa chair is in the sitting posture, the start position of the rearmost end of the chair frame 30 is outside the base 1. In the stretching process, the start position of the rearmost end of the chair frame 30) moves forwards gradually to a position within the range of the base 1, with the motion track not touching the guide rail of the electric motor. That is, the leg telescoping assembly 4 is raised, without sinking the backrest assembly 2, thereby not affecting installation of the electric motor. The chair frame 30 may be a conventional wooden frame or a conventional metal frame.

Referring to FIG. 2 again, when the sofa chair is in the TV posture, the second included angle b between the chair frame 30 and the base 1 is 10 degrees to 15 degrees, for example, may be 12 degrees or 12±1 degrees: and the second height h2 between the lowest point of the chair frame 30 and the ground is 55 mm to 75 mm, for example, may be 61±1 mm.

Referring to FIG. 3 again, when the sofa chair is in the sitting posture, the third included angle c between the chair frame 30 and the base 1 is 5 degrees to 11 degrees. for example. may be 9 degrees or 9±1 degrees: and the third height h3 between the lowest point of the chair frame 30 and the ground is 90 mm to 140 mm. for example, may be 105±1 mm.

The sofa chair of the present application includes a base 1 disposed horizontally, a chair frame assembly 3 indirectly and movably connected to the base 1, a backrest assembly 2 movably connected to one end of the chair frame assembly 3, and a leg telescoping assembly 4 movably connected to another end of the chair frame assembly 3. The chair frame assembly 3 includes a chair frame bracket 31 and a chair frame 30 disposed on the chair frame bracket 31. The chair frame assembly 3 is movably connected to the base 1 by a connection rod structure. The sofa chair is configured to switch between the sitting posture, the TV posture, and the fully lying posture as the state of the connection rod structure changes. When the sofa chair is in the fully lying posture, the first included angle between the chair frame 30 and the horizontal plane is greater than 26 degrees, and the first height between the lowest point of the chair frame 30 and the ground is 60 mm to 100 mm. Alternatively, the first height may be 65 mm to 75 mm, for example, may be 68±1 mm. In this manner, the included angle between the seat plane and the horizontal plane is larger, the zero-gravity experience is more noticeable, and the seat does not interfere with the electric motor.

What is claimed is:

1. A sofa chair, comprising a base disposed horizontally, a chair frame assembly indirectly and movably connected to the base, a backrest assembly movably connected to one end of the chair frame assembly, and a leg telescoping assembly movably connected to another end of the chair frame assembly, wherein the chair frame assembly comprises a chair frame bracket and a chair frame disposed on the chair frame bracket, the chair frame assembly is movably connected to the base by a connection rod structure, and the sofa chair is switchable between a sitting posture, a TV posture and a fully lying posture by changing a state of the connection rod structure, wherein when the sofa chair is in the fully lying posture, a first included angle between the chair frame and a horizontal plane is greater than 26 degrees and less than 30 degrees, and a first height between a lowest point of the chair frame and a ground is 60 mm to 100 mm;

wherein the connection rod structure comprises a first support rod, a second support rod, a first connection rod, a second connection rod, and a third connection rod; the first support rod is hinged at a position of the base adjacent to one end of the base, and the second support rod is hinged at a position of the base adjacent to another end of the base;

the chair frame bracket comprises a first portion and a second portion that is shorter than the first portion and connected to the first portion at an angle from the first portion; the first connection rod is hinged at a position of the chair frame bracket where the first portion is connected to the second portion, and an end of the first connection rod is hinged to the first support rod; the second connection rod is hinged to a middle of the first portion of the chair frame bracket, and an end of the second connection rod is hinged to the second support rod; the third connection rod connects a middle of the first connection rod and a middle of the second connection rod; the first connection rod is V-shaped; and the backrest assembly includes a backrest connector, and one end of the backrest connector is hinged to an end of the first connection rod facing away from the first support rod.

2. The sofa chair of claim 1, wherein the first included angle is 27 degrees, and the first height is 68±1 mm.

3. The sofa chair of claim 2, wherein when the sofa chair is in the TV posture, a second included angle between the chair frame and the horizontal plane is 10 degrees to 15 degrees, and a second height between the lowest point of the chair frame and the ground is 55 mm to 75 mm.

4. The sofa chair of claim 3, wherein the second included angle is 12±1 degrees, and the second height is 61±1 mm.

5. The sofa chair of claim 4, wherein when the sofa chair is in the sitting posture, a third included angle between the chair frame and the horizontal plane is 5 degrees to 11 degrees, and a third height between the lowest point of the chair frame and the ground is 90 mm to 140 mm.

6. The sofa chair of claim 5, wherein the third included angle is 9±1 degrees, and the third height is 105±1 mm.

7. The sofa chair of claim 1, wherein a distance from a hinge point between the first connection rod and the first support rod to a hinge point between the first connection rod and the third connection rod is 120 mm to 130 mm.

8. The sofa chair of claim 7, wherein the distance from the hinge point between the first connection rod and the first support rod to the hinge point between the first connection rod and the third connection rod is 127±1 mm.

9. The sofa chair of claim 8, wherein a distance from the hinge point between the first connection rod and the first support rod to a hinge point between the base and the first support rod is 175 mm to 200 mm.

10. The sofa chair of claim 9, wherein the distance from the hinge point between the first connection rod and the first support rod to the hinge point between the base and the first support rod is 183±1 mm.

11. The sofa chair of claim 2, wherein a distance from a hinge point between the first connection rod and the first support rod to a hinge point between the first connection rod and the third connection rod is 120 mm to 130 mm.

12. The sofa chair of claim 3, wherein a distance from a hinge point between the first connection rod and the first support rod to a hinge point between the first connection rod and the third connection rod is 120 mm to 130 mm.

13. The sofa chair of claim 4, wherein a distance from a hinge point between the first connection rod and the first support rod to a hinge point between the first connection rod and the third connection rod is 120 mm to 130 mm.

14. The sofa chair of claim 5, wherein a distance from a hinge point between the first connection rod and the first support rod to a hinge point between the first connection rod and the third connection rod is 120 mm to 130 mm.

15. The sofa chair of claim 6, wherein a distance from a hinge point between the first connection rod and the first support rod to a hinge point between the first connection rod and the third connection rod is 120 mm to 130 mm.

* * * * *